US008701907B1

(12) United States Patent
Mallicoat

(10) Patent No.: US 8,701,907 B1
(45) Date of Patent: Apr. 22, 2014

(54) COMPOSITE SEALING CAP FOR BOTTLES HAVING NOVELTY FOOTBALL HELMET

(71) Applicant: Tony Mallicoat, New Tazewell, TN (US)

(72) Inventor: Tony Mallicoat, New Tazewell, TN (US)

( * ) Notice: Subject to any disclaimer, the term of this patent is extended or adjusted under 35 U.S.C. 154(b) by 0 days.

(21) Appl. No.: 13/771,423

(22) Filed: Feb. 20, 2013

(51) Int. Cl.
*B65D 23/12* (2006.01)
*B65D 51/18* (2006.01)
*B65D 51/24* (2006.01)

(52) U.S. Cl.
USPC ..... 215/228; 215/364; 215/387; 220/703; 220/711; 446/73; 81/3.4; D9/451

(58) Field of Classification Search
USPC ..... 215/228, 364, 387; 220/703, 711; 446/72–74, 76–78; D7/398; D9/451; 81/3.4
See application file for complete search history.

(56) References Cited

U.S. PATENT DOCUMENTS

| | | | | | |
|---|---|---|---|---|---|
| D23,399 | S | * | 6/1894 | Lee | D9/626 |
| 2,546,122 | A | * | 3/1951 | Goldfarb | 446/72 |
| 3,176,740 | A | * | 4/1965 | Yohe, Jr. | 206/216 |
| 3,684,118 | A | | 8/1972 | Brumme | |
| 3,812,741 | A | * | 5/1974 | Heine | 81/3.4 |
| 3,919,901 | A | * | 11/1975 | Braman | 81/3.4 |
| 4,337,678 | A | * | 7/1982 | Mumford | 81/3.4 |
| 4,702,129 | A | * | 10/1987 | Allen | 81/3.09 |
| 4,760,763 | A | * | 8/1988 | Trick et al. | 81/3.09 |
| D327,817 | S | * | 7/1992 | Paullin | D7/515 |
| D330,856 | S | * | 11/1992 | Kidd | D9/451 |
| D330,857 | S | * | 11/1992 | Kidd | D9/451 |
| 5,483,854 | A | * | 1/1996 | King et al. | 81/3.4 |
| 5,540,611 | A | * | 7/1996 | Lapoint et al. | 446/72 |
| D378,197 | S | | 2/1997 | Leverette et al. | |
| D379,149 | S | * | 5/1997 | Powell et al. | D9/451 |
| D383,953 | S | * | 9/1997 | DeFilippo | D8/38 |
| D387,106 | S | * | 12/1997 | Johnson et al. | D21/658 |
| D391,852 | S | * | 3/1998 | Tucker | D9/451 |
| D399,108 | S | * | 10/1998 | Koefelda | D8/38 |
| 5,857,580 | A | | 1/1999 | Iidaka | |
| D408,236 | S | * | 4/1999 | Rennick | D8/38 |
| D419,880 | S | * | 2/2000 | Adams | D9/451 |
| D432,375 | S | | 10/2000 | Rennick | |
| D471,060 | S | * | 3/2003 | Salsman | D7/392.1 |
| 6,550,271 | B2 | | 4/2003 | Silbert | |
| D478,005 | S | | 8/2003 | Sali | |
| D507,181 | S | * | 7/2005 | Malik | D9/451 |
| D530,200 | S | | 10/2006 | Kingsley | |
| D562,627 | S | * | 2/2008 | McDonald | D7/398 |
| D566,461 | S | * | 4/2008 | McDonald | D7/398 |
| D589,748 | S | * | 4/2009 | McDonald | D7/398 |
| D595,467 | S | * | 6/2009 | Wolford et al. | D34/4 |
| D596,363 | S | * | 7/2009 | Wolford et al. | D34/4 |

(Continued)

*Primary Examiner* — J. Gregory Pickett
*Assistant Examiner* — Ned A Walker

(57) ABSTRACT

A bottle sealing system for resealing an opened beverage bottle features a conical sealing member. The conical sealing member features a lower ridge and an upper ridge located around the sealing member side wall outside surface. The conical sealing member features an upper groove located around the sealing member side wall inside surface. The upper groove is located opposed to the upper ridge. The upper groove is adapted to receive a beverage bottle ridge located around a beverage bottle neck. The system features a compression cap resembling a football helmet. A compression cap groove is located around the compression cap side wall inside surface. The conical sealing member is adapted to slide over an open bottle. The compression cap is adapted to slide over the conical sealing member. The compression cap groove is adapted to snap over the upper ridge of the conical sealing member.

6 Claims, 3 Drawing Sheets

(56) References Cited

U.S. PATENT DOCUMENTS

| | | | | | |
|---|---|---|---|---|---|
| D596,670 | S | * | 7/2009 | Baker | D19/82 |
| D597,789 | S | * | 8/2009 | McDonald | D7/398 |
| D602,736 | S | * | 10/2009 | McDonald | D7/398 |
| D607,939 | S | * | 1/2010 | Baker | D19/82 |
| 7,665,607 | B1 | * | 2/2010 | Hanan | 206/457 |
| D629,648 | S | * | 12/2010 | McDonald | D7/398 |
| D653,948 | S | * | 2/2012 | Azar | D9/451 |
| D663,575 | S | * | 7/2012 | Carroll et al. | D7/392.1 |
| D673,811 | S | * | 1/2013 | Roudybush | D7/510 |
| 2006/0151426 | A1 | | 7/2006 | Peters | |
| 2008/0023433 | A1 | | 1/2008 | Romero | |

* cited by examiner

COMPOSITE SEALING CAP FOR BOTTLES HAVING NOVELTY FOOTBALL HELMET

FIELD OF THE INVENTION

The present invention relates to bottle sealing systems. More specifically, resealing systems for beverage bottles.

BACKGROUND OF THE INVENTION

For sealing the top opening of a bottle, a bottle cap is often used. Typically plastic caps are used for plastic bottles and metal with a plastic backing is used for glass bottles. Often for beverage bottles, the caps are not resealable making the beverage susceptible to spillage or allowing it to lose carbonation to the atmosphere at a more rapid rate than a sealed bottle. The present invention features a bottle sealing system for resealing an opened beverage bottle with a novel appeal for sports fans.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a bottle sealing system for resealing an opened beverage bottle. In some embodiments, the bottle sealing system comprises a conical sealing member. In some embodiments, the conical sealing member comprises a lower ridge and an upper ridge located around the sealing member side wall outside surface. In some embodiments, the conical sealing member comprises an upper groove located around the sealing member side wall inside surface. In some embodiments, the upper groove is located opposed to the upper ridge. In some embodiments, the upper groove is adapted to receive a beverage bottle ridge located around a beverage bottle neck.

In some embodiments, the system comprises a compression cap resembling a football helmet. In some embodiments, a compression cap groove is located around the compression cap side wall inside surface. In some embodiments, the conical sealing member is adapted to sealably slide over an open bottle. In some embodiments, the compression cap is adapted to slide over the conical sealing member. In some embodiments, the compression cap groove is adapted to compressibly snap over the upper ridge of the conical sealing member.

DESCRIPTION OF PREFERRED EMBODIMENTS

Figure 1:
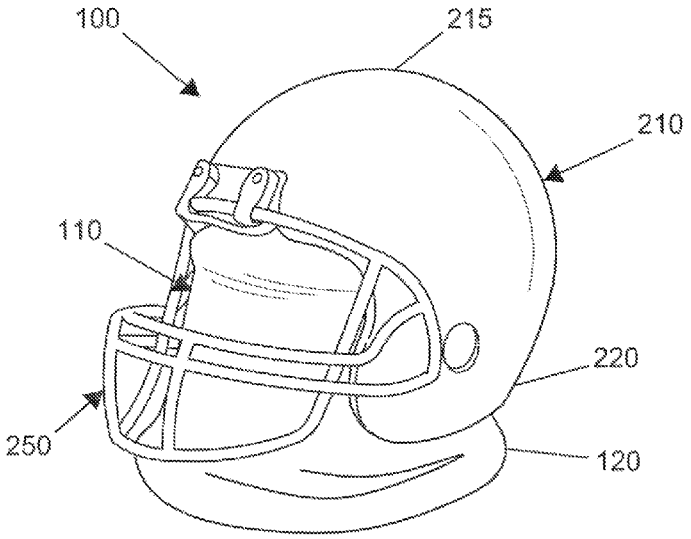
FIG. 1 shows a perspective view of the present invention.
Figure 2:
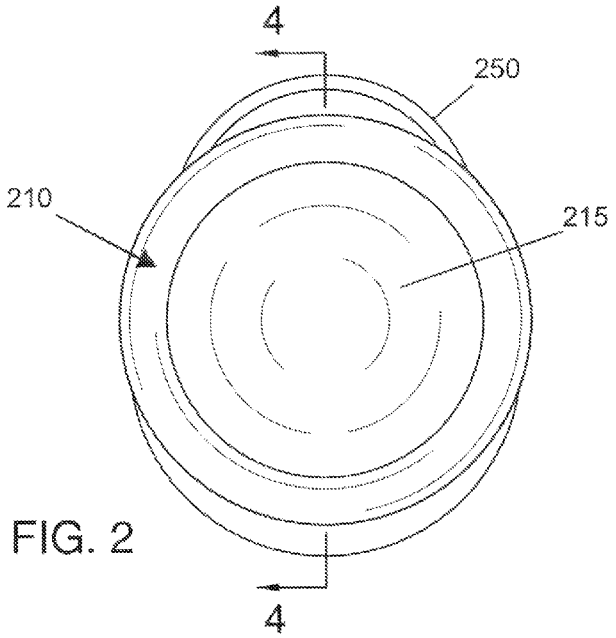
FIG. 2 shows an overhead view of the present invention.
Figure 3:
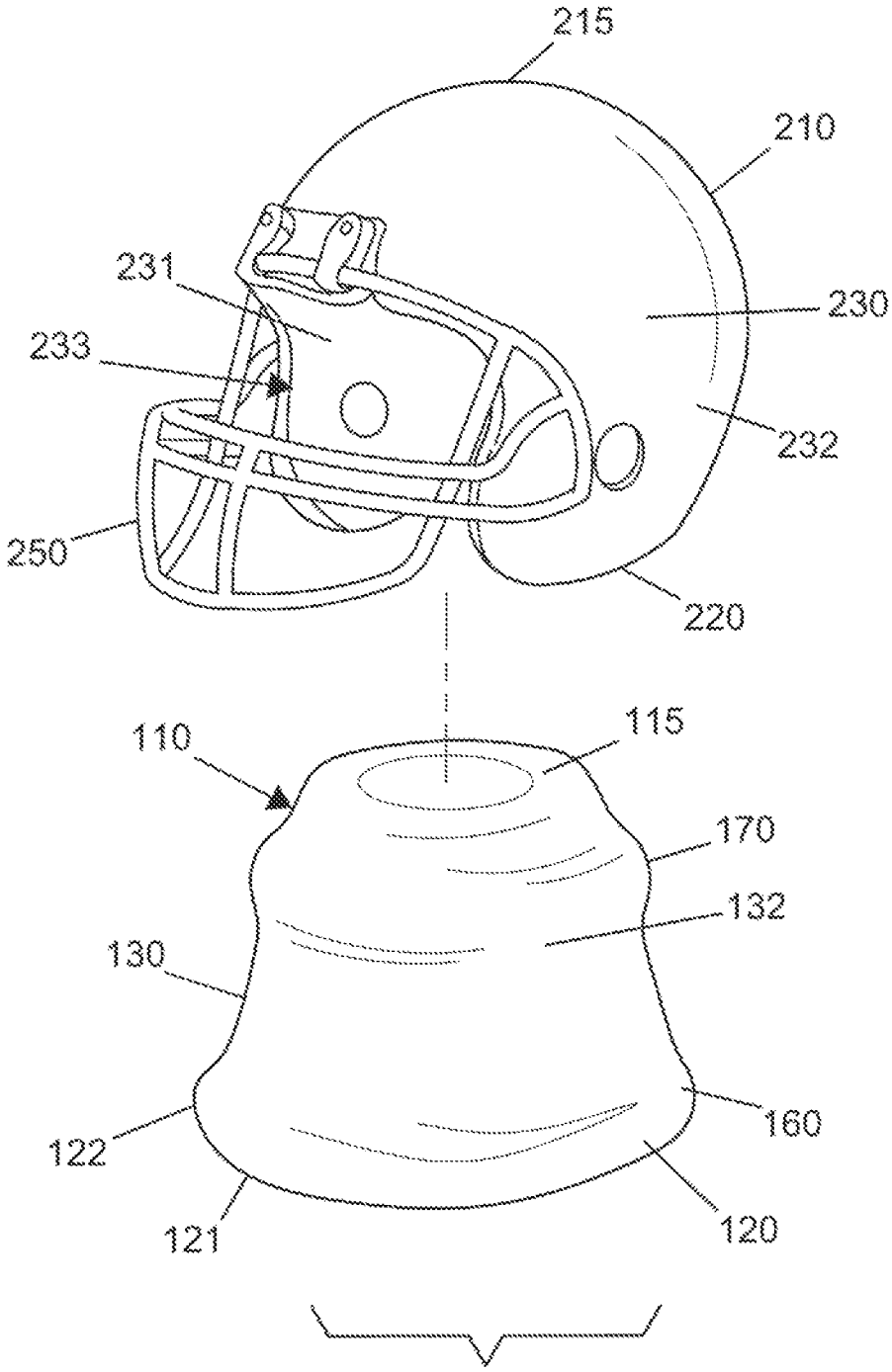
FIG. 3 shows a perspective view of the conical sealing member and the compression cap of the present invention.
Figure 4:
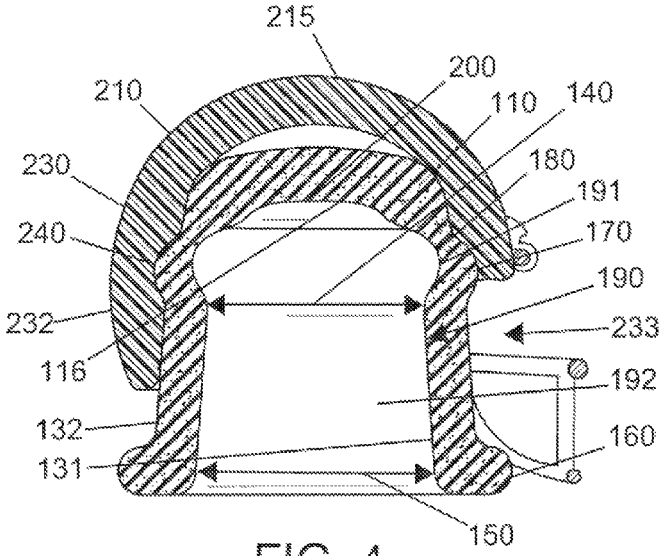
FIG. 4 shows a cross-sectional view of the present invention in a sagittal plane.
Figure 5:
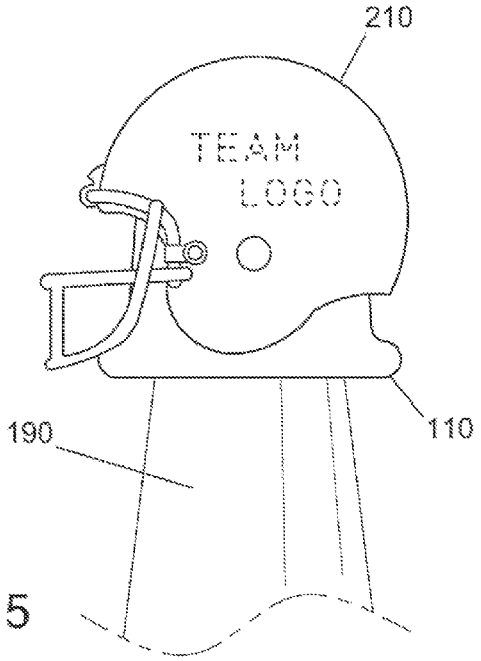
FIG. 5 shows a side view of the present invention.

Following is a list of elements corresponding to a particular element referred to herein:

100 Bottle sealing system
110 Conical sealing member
115 Top sealing member end
116 Top sealing member end inside surface
120 Bottom sealing member end
121 Bottom sealing member edge
122 Bottom sealing member edge outer periphery
130 Sealing member side wall
131 Sealing member side wall inside surface
132 Sealing member side wall outside surface
140 Upper diameter
150 Lower diameter
160 Lower ridge
170 Upper ridge
180 Upper groove
190 Beverage bottle
191 Beverage bottle ridge
192 Beverage bottle neck
200 Upper indention
210 Compression cap
215 Top compression cap end
220 Bottom compression cap end
230 Compression cap side wall
231 Compression cap side wall inside surface
232 Compression cap side wall outside surface
233 Compression cap open side area
240 Compression cap groove
250 Face mask Referring now to FIG. 1-5, the present invention features a bottle sealing system (100) for resealing an opened beverage bottle (190). In some embodiments, the bottle sealing system (100) comprises a conical sealing member (110) having an enclosed top sealing member end (115), an open bottom sealing member end (120), and a sealing member side wall (130) having a sealing member side wall inside surface (131) and a sealing member side wall outside surface (132).

In some embodiments, the conical sealing member (110) comprises an upper diameter (140) close to the top sealing member end (115) smaller than a lower diameter (150) close to the bottom sealing member end (120). In some embodiments, the diameter of the conical sealing member (110) increases from the top sealing member end (115) to the bottom sealing member end (120).

In some embodiments, the conical sealing member (110) comprises a lower ridge (160) located around a bottom sealing member edge outer periphery (122) of a bottom sealing member edge (121) on the sealing member side wall outside surface (132) thereon. In some embodiments, the lower ridge (160) is adapted to assist a user in breaking a seal when removing the conical sealing member (110).

In some embodiments, the conical sealing member (110) comprises an upper ridge (170) located around the sealing member side wall outside surface (132) close to the top sealing member end (115). In some embodiments, the upper ridge (170) is parallel with and offset from the lower ridge (160).

In some embodiments, the conical sealing member (110) comprises an upper groove (180) located around the sealing member side wall inside surface (131) close to the top sealing member end (115). In some embodiments, the upper groove (180) is located on the sealing member side wall (130) opposed to the upper ridge (170). In some embodiments, the upper groove (180) is adapted to receive a beverage bottle ridge (191) located around a beverage bottle neck (192) thereon.

In some embodiments, the conical sealing member (110) comprises an upper indention (200) located on a top sealing member end inside surface (116) of the top sealing member end (115). In some embodiments, the upper indention (200) is adapted to provide increased head space for the beverage bottle (190) for pressure stabilization (allowing for expansion and contraction).

In some embodiments, the system (100) comprises a compression cap (210) resembling a football helmet having an enclosed top compression cap end (215), an open bottom compression cap end (220), and a compression cap side wall (230) having a hemispherical compression cap side wall inside surface (231) and a hemispherical compression cap side wall outside surface (232). In some embodiments, a compression cap open side area (233) is located on a compression cap side wall (230).

In some embodiments, a compression cap groove (240) is located around the compression cap side wall inside surface (231) between the top compression cap end (215) and the compression cap open side area (233). In some embodiments, the compression cap (210) is constructed from a rigid plastic.

In some embodiments, the conical sealing member (110) is adapted to sealably slide over the beverage bottle neck (192) of the open beverage bottle (190). In some embodiments, the compression cap (210) is adapted to slide over the conical sealing member (110). In some embodiments, the compression cap groove (240) is adapted to compressibly snap over the upper ridge (170) of the conical sealing member (110). In some embodiments, the bottle sealing system (100) is for resealing an opened beverage bottle (190).

In some embodiments, a team logo is located on the compression cap side wall outside surface (232). In some embodiments, a face mask (250) is located over the compression cap open side area (233). In some embodiments, the conical sealing member (110) is constructed from a rubber. In some embodiments, the conical sealing member (110) is constructed from a compressible material.

In some embodiments, the beverage bottle (190) is a beer bottle. In some embodiments, the beverage bottle (190) is a soda bottle. In some embodiments, the system (100) is adapted to fit only glass beverage bottles (190). In some embodiments, the system (100) is not adapted to fit bottles other than beverage bottles (190). In some embodiments, the system (100) is not adapted to fit plastic beverage bottles (190).

As used herein, the term "about" refers to plus or minus 10% of the referenced number.

The disclosures of the following U.S. Patents are incorporated in their entirety by reference herein: U.S. Pat. No. D 530,200; U.S. Pat. No. D 478,005; U.S. Pat. No. D 432,375; U.S. Pat. No. D 378,197; U.S. Patent Publication No. 2008/0023433 A1; U.S. Patent Publication No. 2006/0151426 A1; U.S. Pat. No. 6,550,271; U.S. Pat. No. 5,857,580; and U.S. Pat. No. 3,684,118.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way.

The reference numbers recited in the below claims are solely for ease of examination of this patent application, and are exemplary, and are not intended in any way to limit the scope of the claims to the particular features having the corresponding reference numbers in the drawings.

What is claimed is:

1. A bottle sealing system (100) for resealing an opened beverage bottle (190), wherein the bottle sealing system (100) comprises:

(a) a conical sealing member (110) having an enclosed top sealing member end (115), an open bottom sealing member end (120), and a sealing member side wall (130) having a sealing member side wall inside surface (131) and a sealing member side wall outside surface (132), wherein the conical sealing member (110) comprises an upper diameter (140) proximal to the top sealing member end (115) smaller than a lower diameter (150) proximal to the bottom sealing member end (120), wherein the diameter of the conical sealing member (110) increases from the top sealing member end (115) to the bottom sealing member end (120), wherein the conical sealing member (110) comprises a lower ridge (160) disposed around a bottom sealing member edge outer periphery (122) of a bottom sealing member edge (121) on the sealing member side wall outside surface (132) thereon, wherein the conical sealing member (110) comprises an upper ridge (170) disposed around the sealing member side wall outside surface (132) proximal to the top sealing member end (115), wherein the upper ridge (170) is parallel with and offset from the lower ridge (160), wherein the conical sealing member (110) comprises an upper groove (180) disposed around the sealing member side wall inside surface (131) proximal to the top sealing member end (115), wherein the upper groove (180) is disposed on the sealing member side wall (130) opposed to the upper ridge (170), wherein the upper groove (180) is adapted to receive a beverage bottle ridge (191) disposed around a beverage bottle neck (192) thereon, wherein the conical sealing member (110) comprises an upper indention (200) disposed on a top sealing member end inside surface (116) of the top sealing member end (115); and (b) a compression cap (210) resembling a football helmet having an enclosed top compression cap end (215), an open bottom compression cap end (220), and a compression cap side wall (230) having a hemispherical compression cap side wall inside surface (231) and a hemispherical compression cap side wall outside surface (232), wherein a compression cap open side area (233) is disposed on the compression cap side wall (230), wherein a compression cap groove (240) is disposed around the compression cap side wall inside surface (231) between the top compression cap end (215) and the compression cap open side area (233), wherein the conical sealing member (110) is adapted to sealably slide over the beverage bottle neck (192) of the open beverage bottle (190), wherein the compression cap (210) is adapted to slide over the conical sealing member (110), wherein the compression cap groove (240) is adapted to compressibly snap over the upper ridge (170) of the conical sealing member (110), wherein the bottle sealing system (100) is for resealing the opened beverage bottle (190).

2. The system (100) of claim 1, wherein a team logo is disposed on the compression cap side wall outside surface (232).

3. The system (100) of claim 1, wherein a face mask (250) is disposed over the compression cap open side area (233).

4. The system (100) of claim 1, wherein the conical sealing member (110) is constructed from a rubber.

5. The system (100) of claim 1, wherein the beverage bottle (190) is a beer bottle.

6. The system (100) of claim 1, wherein the beverage bottle (190) is a soda bottle.

* * * * *